US010889460B2

(12) United States Patent
Ferguson

(10) Patent No.: US 10,889,460 B2
(45) Date of Patent: Jan. 12, 2021

(54) MATERIAL HANDLING DEVICE

(71) Applicant: Eric Martin Ferguson, Annandale, MN (US)

(72) Inventor: Eric Martin Ferguson, Annandale, MN (US)

( * ) Notice: Subject to any disclaimer, the term of this patent is extended or adjusted under 35 U.S.C. 154(b) by 247 days.

(21) Appl. No.: 15/801,628

(22) Filed: Nov. 2, 2017

(65) Prior Publication Data

US 2018/0118502 A1 May 3, 2018

Related U.S. Application Data

(60) Provisional application No. 62/417,176, filed on Nov. 3, 2016.

(51) Int. Cl.
*B65H 49/36* (2006.01)
*B65H 75/18* (2006.01)

(52) U.S. Cl.
CPC ..... *B65H 49/36* (2013.01); *B65H 75/185* (2013.01)

(58) Field of Classification Search
CPC ..... B65H 49/36; B65H 54/543; B65H 75/08; B65H 75/185; B65H 2301/41342
See application file for complete search history.

(56) References Cited

U.S. PATENT DOCUMENTS

| | | | | |
|---|---|---|---|---|
| 246,402 A | | 8/1881 | McClure | |
| 416,842 A | | 12/1889 | Johnson | |
| 417,133 A | | 12/1889 | Barrett | |
| 720,141 A | | 2/1903 | Hayes | |
| 862,109 A | | 7/1907 | Roth | |
| 894,206 A | | 7/1908 | Husby | |
| 1,001,861 A | * | 8/1911 | Kennedy | B65H 75/08 242/599.2 |
| 1,037,988 A | | 9/1912 | Richards | |
| 1,132,440 A | | 3/1915 | Louis | |
| 1,244,865 A | * | 10/1917 | Krohn | B65H 16/06 242/578.1 |
| 1,671,724 A | * | 5/1928 | Johancen | B65H 75/08 242/599.2 |
| 1,682,309 A | | 8/1928 | Schoenfeld | |
| 1,704,166 A | | 3/1929 | Calabrese | |
| 1,789,481 A | | 1/1931 | Stone | |

(Continued)

FOREIGN PATENT DOCUMENTS

GB 711140 6/1954

OTHER PUBLICATIONS

"Commercial 1100-18 Cable Drum, Vertical Lift," American Garage Door Supply Inc. product description retrieved from URL <http://www.americandoorsupply.com/Commercial-1100-18-Cable-Drum-Vertical-Lift-p/1100-18s.htm> Aug. 26, 2016 (2 pages).

(Continued)

*Primary Examiner* — William A. Rivera
(74) *Attorney, Agent, or Firm* — Pauly, DeVries Smith & Deffner LLC

(57) ABSTRACT

An apparatus for retaining a utility reel on a horizontal shaft, said apparatus comprising a first rotational collar and a second rotational collar configured to be attached to the horizontal shaft on either side of the utility spool. The apparatus is held in place by set screws, the set screws typically being such that they cannot be removed without grinding or cutting so as to not vibrate loose while transporting said reel.

19 Claims, 15 Drawing Sheets

(56) References Cited

U.S. PATENT DOCUMENTS

| | | | | | |
|---|---|---|---|---|---|
| 1,804,585 | A | | 5/1931 | Barner et al. | |
| 2,055,039 | A | * | 9/1936 | Meisel | B65H 75/08 242/573.5 |
| 2,332,576 | A | | 10/1943 | Iversen et al. | |
| 2,523,972 | A | * | 9/1950 | Sharratt | B23Q 1/70 384/439 |
| 2,535,815 | A | * | 12/1950 | Seeger | B65H 19/126 242/559.1 |
| 2,837,295 | A | | 6/1958 | Todd et al. | |
| 2,943,807 | A | | 7/1960 | Loop | |
| 3,127,125 | A | | 3/1964 | Jilbert | |
| 3,278,134 | A | | 10/1966 | Cochrane | |
| 3,822,837 | A | | 7/1974 | Celebonovic | |
| 3,955,770 | A | | 5/1976 | Offermann | |
| 3,977,617 | A | * | 8/1976 | Salmon | B65H 35/04 242/421.2 |
| 4,353,515 | A | | 10/1982 | Weaver et al. | |
| 4,728,048 | A | * | 3/1988 | Batson | A01K 89/003 242/129.51 |
| 4,948,064 | A | | 8/1990 | Richard | |
| 5,597,135 | A | * | 1/1997 | Vandersteene | B65H 16/005 242/599.3 |
| 5,626,309 | A | | 5/1997 | Morgan | |
| 5,718,108 | A | * | 2/1998 | Oppl | B65H 54/543 242/597.4 |
| 5,771,807 | A | | 6/1998 | Moss | |
| 5,820,069 | A | | 10/1998 | Segura Salvador et al. | |
| 6,299,100 | B1 | | 10/2001 | Cloud | |
| 6,488,285 | B1 | * | 12/2002 | Allard | B23B 31/305 279/102 |
| 8,371,518 | B2 | | 2/2013 | Factor | |
| 9,403,659 | B2 | | 8/2016 | Galindo Gonzalez et al. | |
| 2005/0051406 | A1 | * | 3/2005 | Hopper | B25H 1/0028 191/12.2 R |
| 2006/0055125 | A1 | * | 3/2006 | Ohnesorge | G01M 1/045 279/2.12 |
| 2007/0029437 | A1 | * | 2/2007 | Gaines | B32B 37/0046 242/599.3 |
| 2007/0246900 | A1 | * | 10/2007 | Oshnock | B23B 31/20 279/9.1 |
| 2015/0150422 | A1 | | 6/2015 | Ochoa et al. | |

OTHER PUBLICATIONS

Johnson, Ian "Solidoodle Tips: FilaWinder," mechanical assembly instructions for FilaWinder posted by Ian Johnson on Solidoodletips.wordpress.com 10/15/13 (40 pages).

"Rs Pro M20 Grey EPDM, IP67 Cable Gland," RS Components Ltd. product details retrieved from URL <https://uk.rs-online.com/web/p/cable-glands/2797037/> Aug. 26, 2016 (3 pages).

Zhao, Frank "Ultimaker2 Bearing Spool and Bearing Guide Upgrade," Eleccelerator post URL <eleccelerator.com/ultimaker2-bearing-spool-and-bearing-guide-upgrade/> Jan. 14, 2015 (2 pages).

* cited by examiner

MATERIAL HANDLING DEVICE

This application claims the benefit of U.S. Provisional Application No. 62/417,176, filed Nov. 3, 2017, the content of which is herein incorporated by reference in its entirety.

FIELD

Embodiments herein relate to an apparatus in use with utility spools. More specifically, embodiments herein relate to an apparatus for retaining a utility spool on a horizontal shaft.

BACKGROUND

Conduit, pipe, ducts, communications cables, and coaxial cables and similar materials are used for delivering gas, water, sewer, irrigation, fuel, power, electricity, internet, television, etc. These materials are often wound onto a utility spool for means of transportation and installation. After the materials are wound onto a utility spool, the utility spools are then placed on a horizontal shaft on vehicle (such as a trailer, truck, or plow machine) transported to the construction job site. Some utility spools can be heavy, which can cause an increase of friction as cables are being dispensed due to the weight of the utility spools making contact with the horizontal shaft. Such friction can make dispensing the cable difficult and dangerous as workers are subject to increasing their effort to lay cable. Not only is laying cable a danger for workers because of the load placed on unwinding, but the utility spool is free to move about the horizontal shaft, making it difficult to control. A need exists for an improved application and method to retain a utility spool on a horizontal shaft.

SUMMARY

An apparatus is described herein including two rotational collars configured on a horizontal shaft to allow for rotational movement of a utility spool. As used herein, utility spools include reels, drums, and other articles, typically for holding a material wound around the spool, such as a cable. The apparatus further includes a first and a second sleeve for each collar, the first sleeve is can be referred to as the inside sleeve intended to make contact with the horizontal shaft while the second sleeve is an outer sleeve intended to mate with the outside surface of the first sleeve forming a lubricious surface, and to make contact with the utility spool to allow for rotational movement of the utility spool in a fixed position on the horizontal shaft.

Embodiments herein include an apparatus for retaining a utility spool on a horizontal shaft. In an embodiment, said apparatus includes a first rotational collar and a second rotational collar configured to be attached to the horizontal shaft on either side of the utility spool. Each of the two rotational collars contain a first sleeve and a second frusto-conical sleeve. The first sleeve and second frusto-conical sleeve form a lubricious surface, and when installed the first rotational collar and the second rotational collar face opposite each other when positioned inside each side of the utility spool.

In an embodiment said apparatus includes a first rotational collar and a second rotational collar configured to be attached to the horizontal shaft on either side of the utility spool. Each of the two rotational collars contain a first sleeve, comprising an inner surface and an outer surface of cylindrical geometry, the first sleeve having an inner diameter, a first outer diameter, and a second outer diameter. The first outer diameter is located on a first end of the sleeve and the second outer diameter is located on a second end of the sleeve, the second end is indicated by an external flange and at least one hole through the flange. Additionally, each of the two rotational collars contain a second sleeve, comprising an inner surface and a frusto-conical outer surface, the second sleeve having a first outer diameter on a first end of the second sleeve and a second outer diameter on a second end of the second sleeve. The second outer diameter is said to be no more than 1.5 times greater than the inner diameter of the first sleeve or whatever size is required. The thickness of the first end is said to be less than 4 times the thickness of the second end, or whatever is required. The angle formed by the frusto-conical outer surface and inner surface is said to be between 15 and 25 degrees, or whatever is required. Said apparatus also contains a lip on the second outer diameter to prevent rotation against a non-rotational surface. The second end of the second sleeve abuts the external flange on the first sleeve, while the outer surface of the first sleeve makes contact with the inner surface of the second sleeve, thus forming a lubricious surface. The inner surface of the first sleeve is the only surface to make contact with the horizontal shaft, and the inner surface of the first sleeve does not rotate on said horizontal shaft. When installed, the first ends face one another while at least partially inserted into a spool opening and the second ends oppose one another. Note that, in some implementations the apparatus does not rotate, but the apparatus still maintains the location of the spool.

A method is described herein for fastening a utility spool to a horizontal shaft. The first collar is fastened to the horizontal shaft by means of at least one set screw, and the first collar is at least partially inserted into a first end of the utility spool. The second collar is fastened to the horizontal shaft by means of at least one set screw, and the second collar is at least partially inserted into a second end of the utility spool. Said set screws restrict rotational movement of said collars and allow for varying horizontal shaft diameters.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures, in which.

Figure 1:
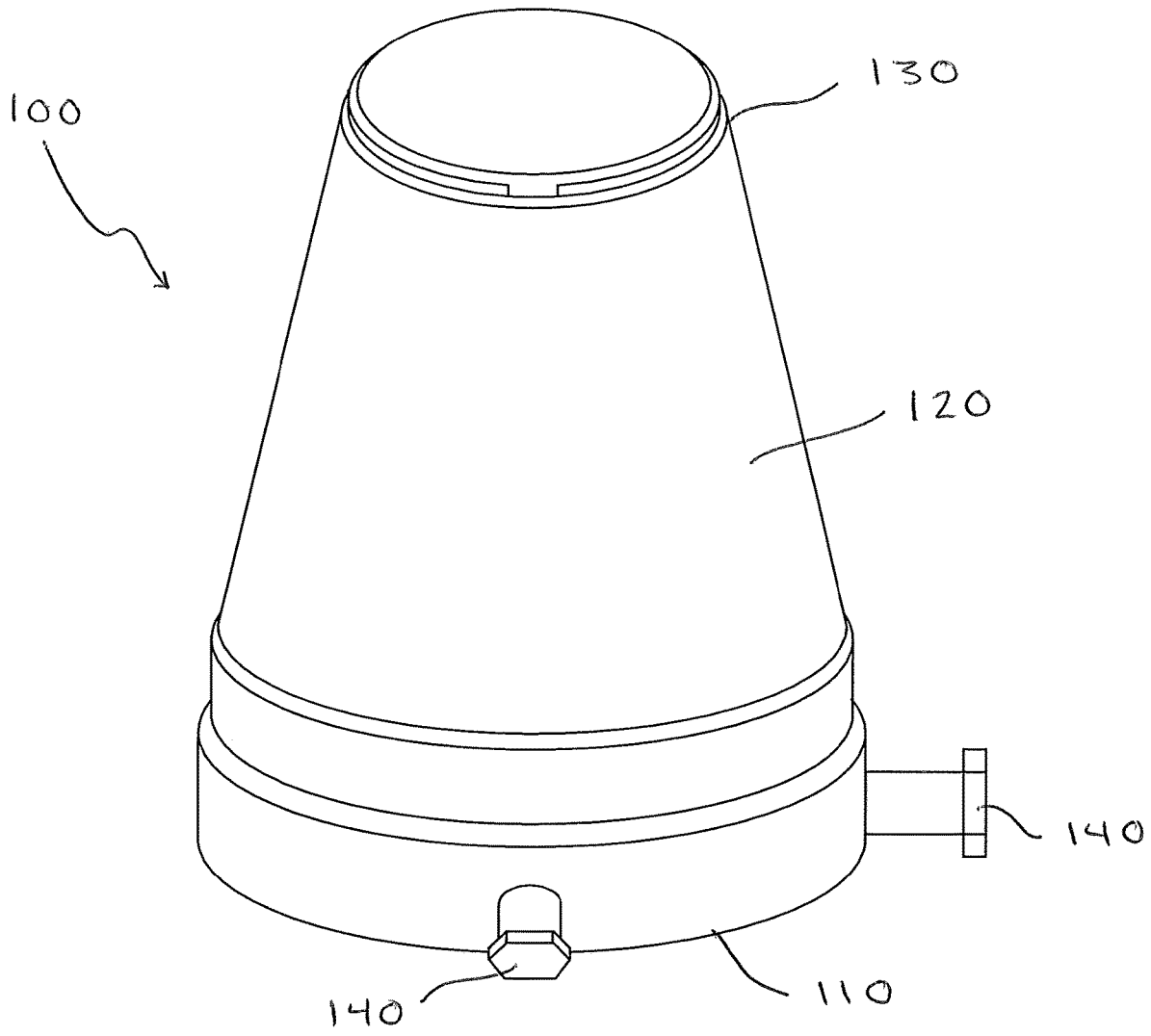
FIG. 1 is a perspective view of a rotational collar for retaining a utility spool, reel or drum on a horizontal shaft.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

The embodiments described herein are not intended to be exhaustive or to limit the invention to the precise forms disclosed in the following detailed description. Rather, the embodiments are chosen and described so that others skilled in the art can appreciate and understand the principles and practices.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

In one embodiment, an apparatus for retaining a utility spool on a horizontal shaft comprises of a first rotational collar and a second rotational collar, each configured to be attached to the horizontal shaft on either side of the utility spool. In said embodiment, the two rotational collars may contain a first sleeve and a second sleeve. In certain embodiments, the second sleeve may have a tapered exterior surface. For example, the tapered outer surface on the second sleeve may be comprised of a frusto-conical geometry or of similar conical geometry. In said embodiment, the first sleeve and second frusto-conical sleeve form a lubricious surface when mated. When the apparatus is installed, the first rotational collar and the second rotational collar face each other when positioned inside each side of the utility spool.

In addition or alternatively, the apparatus may include of set screws to fasten the mechanism to the horizontal shaft. For example, the apparatus may consist of at least 3 screws offset by 120 degrees, the apparatus may consist of at least 4 screws offset by 90 degrees. Said set screws allow for the apparatus to remain in a fixed position inside each end of the utility spool. In certain embodiments a retainer ring may be used to fix the second sleeve to the first sleeve.

In addition or alternatively, the first sleeve and second sleeve may be comprised of metal. For example, the first sleeve may be comprised of steel and the second sleeve may be comprised of brass. In some embodiments, the first sleeve and second sleeve may be comprised of similar metals such as steel, aluminum, brass, bronze, iron, tin, nickel, magnesium, or any metal similar or combination thereof. In some embodiments, the first sleeve and second sleeve may be comprised of a plastic material. For example, the first sleeve and second sleeve may be comprised of a thermoplastic or thermoset material such as ABS, polyethylene, polyvinyl chloride, polyurethanes polymers, or any thermoplastic or thermoset material similar or combination thereof.

In addition or alternatively, the apparatus may various spool diameters. For example, the apparatus may be configured to encompass spool diameters of 3-3.5 inches. In some embodiments the apparatus can be adapted to encompass varying horizontal shaft diameters by means of set screws.

In addition or alternatively, lubricious surface between the first sleeve and the second sleeve may be comprised of a bearing assembly. For example, the bearing assembly may be comprised of ball bearings, roller bearings, thrust ball bearings, thrust roller bearings, tapered roller bearings, magnetic bearings, rotary bearings, or any similar bearing assembly.

In another embodiment, an apparatus for retaining a utility spool on a horizontal shaft comprises of a first rotational collar and a second rotational collar, each configured to be attached to the horizontal shaft on either end of the utility spool. In said embodiment, the two rotational collars may contain a first sleeve and a second sleeve. In some embodiments the first sleeve may be comprised of an inner surface and an outer surface of cylindrical geometry, and the first sleeve may contain an inner diameter, a first outer diameter and a second outer diameter wherein the first outer diameter is located on a first end of the sleeve and the second outer diameter is located on a second end of the sleeve indicated by an external flange and at least one hole through the flange. Additionally, in some embodiments the second sleeve may be comprised of an inner surface and an outer surface. In certain embodiments, the second sleeve may have a tapered exterior surface. For example, the tapered outer surface on the second sleeve may be comprised of a frusto-conical geometry or of similar conical geometry. In some embodiments the second sleeve having a first outer diameter on a first end of the second sleeve, and a second outer diameter on a second end of the second sleeve. In some embodiments, the second outer diameter is no more than 1.5 times greater than the inner diameter of the first sleeve. In some embodiments, the thickness of the first end may be less than 4 times the thickness of the second end. In some embodiments, the angle formed by the frusto-conical outer surface and inner surface is between 15-25 degrees. The second sleeve can contain a lip on the second outer diameter to prevent rotation against a non-rotational surface. For example, the lip prevents the spool shaft from making rotational contact with the second diameter of the first sleeve. Said rotational contact would be destructive to the invention purpose. In some embodiments the second end of the second sleeve may abut the external flange on the first sleeve. In addition or alternatively, the outer surface of the first sleeve forms a lubricious surface with the inner surface of the second sleeve. In some embodiments, the inner surface of the first sleeve is the only surface to make contact with the horizontal shaft, and the inner surface of the first sleeve does not rotate. As described above, when installed the first ends face one another while at least partially inserted into a spool opening and the second ends oppose each other. In the invention, both first and second ends of the first and second sleeve directly relate to each other.

In addition or alternatively, the apparatus may include set screws to fasten the mechanism to the horizontal shaft. For example, the apparatus may consist of at least 3 screws offset by 120 degrees, the apparatus may consist of at least 4 screws offset by 90 degrees. Said set screws allow for the apparatus to remain in a fixed position inside each end of the utility spool. In certain embodiments a retainer ring may be used to fix the second sleeve to the first sleeve. Also, the screws can be modified after installation so they do not easily fall out of the collar, such as by vibration during use or transport. This modification can comprise, for example, apply a bead of metal by welding to the end threads on the screw.

In addition or alternatively, the first sleeve and second sleeve may be comprised of metal. For example, the first sleeve may be comprised of steel and the second sleeve may be comprised of brass. In some embodiments, the first sleeve and second sleeve may be comprised of similar metals such as steel, aluminum, brass, iron, tin, nickel, magnesium, or any metal similar or combination thereof. In some embodiments, the first sleeve and second sleeve may be comprised of a plastic material. For example, the first sleeve and second sleeve may be comprised of a thermoplastic or thermoset material such as ABS, polyethylene, polyvinyl chloride, polyurethanes polymers, or any thermoplastic or thermoset material similar or combination thereof.

In addition or alternatively, the apparatus may hold various spool diameters. For example, the apparatus may be configured to encompass spool diameters of 3-3.5 inches. In some embodiments the apparatus can be adapted to encompass varying horizontal shaft diameters by means of set screws.

In addition or alternatively, lubricious surface between the first sleeve and the second sleeve may be comprised of a bearing assembly. For example, the bearing assembly may be comprised of ball bearings, roller bearings, thrust ball bearings, thrust roller bearings, tapered roller bearings, magnetic bearings, rotary bearings, or any similar bearing assembly.

In some embodiments, a first collar is fastened to a horizontal shaft by means of at least one set screw and at least partially inserted into a first end of a utility spool. For example, in some embodiments the first collar may be fastened to the horizontal shaft by at least one set screw, in some embodiments the first collar may be fastened to the horizontal shaft by at least two set screws, in some embodiments the first collar may be fastened to the horizontal shaft by at least three set screws, in some embodiments the first collar may be fastened to the horizontal shaft by at least four set screws. In some embodiments, a second collar is fastened to a horizontal shaft by means of at least one set screw and at least partially inserted into a second end of a utility spool. For example, in some embodiments the second collar may be fastened to the horizontal shaft by at least two set screw, in some embodiments the second collar may be fastened to the horizontal shaft by at least three set screw, in some embodiments the second collar may be fastened to the horizontal shaft by at least four set screw. The set screws restrict rotational movement of said collars and in some embodiments, allow for varying horizontal shaft diameters.

Referring now to FIG. 1, a perspective view is shown of a rotational collar 100 to be used in combination with a similar or identical rotational collar to comprise an apparatus for retaining a utility spool on a horizontal shaft consistent with at least one embodiment of the technology disclosed herein. The rotational collar shown includes a first sleeve 110, a second frusto-conical sleeve 120 fastened to the first sleeve 110 by means of a retainer ring 130, said first sleeve 110 and second frusto-conical sleeve 120 forming a lubricious surface allowing the second frusto-conical sleeve to rotate freely while the first sleeve 110 does not rotate. Set screws 140 are used to fix the rotational collar 100 in place.

Figure 2:
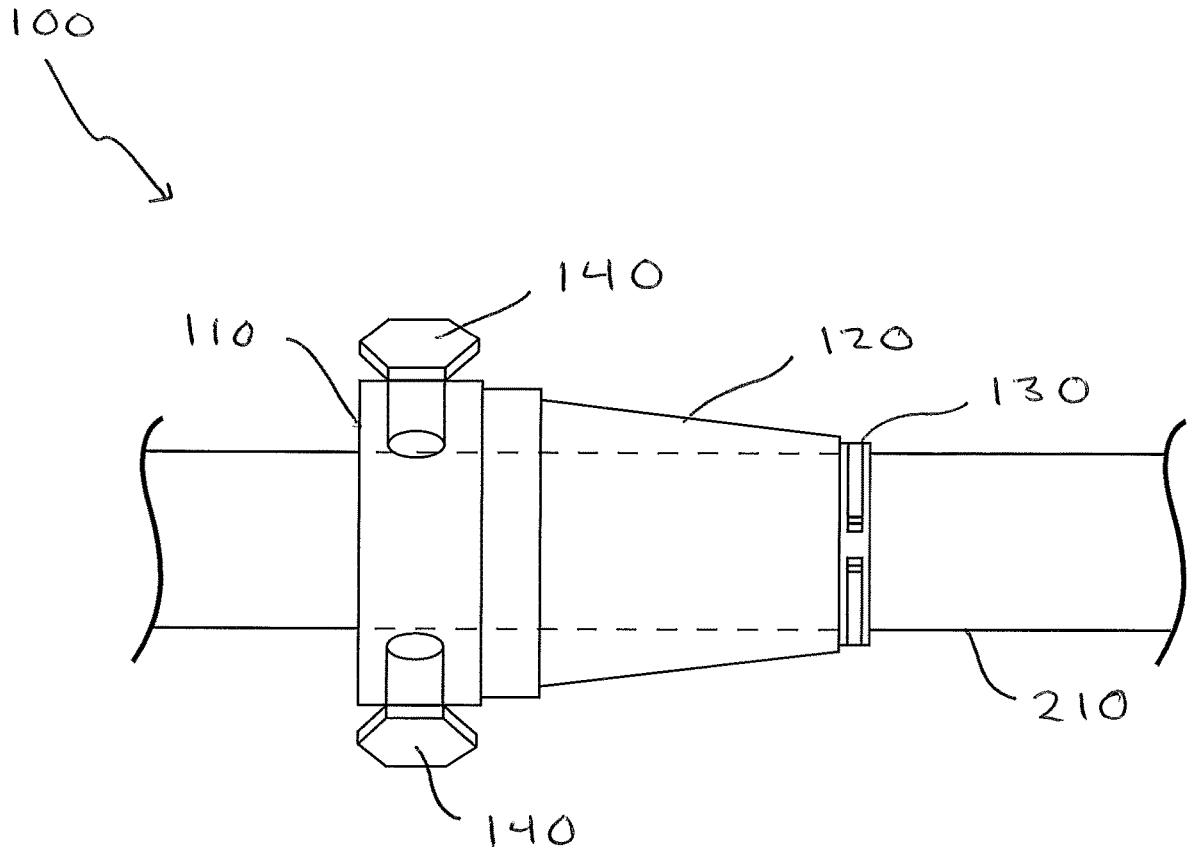
FIG. 2 is a side view of a rotational collar fastened on a horizontal shaft.

Referring now to FIG. 2, a side view is shown of a rotational collar 100 fastened in a fixed location to a horizontal shaft 210 by means of set screws 140 in accordance with various embodiments herein. In this view, the rotational collar 100 is related to that of which is shown in FIG. 1 where said rotational collar 100 is comprised of a first sleeve 110, a second frusto-conical sleeve 120, a retainer ring 130, and set screws 140.

Figure 3:
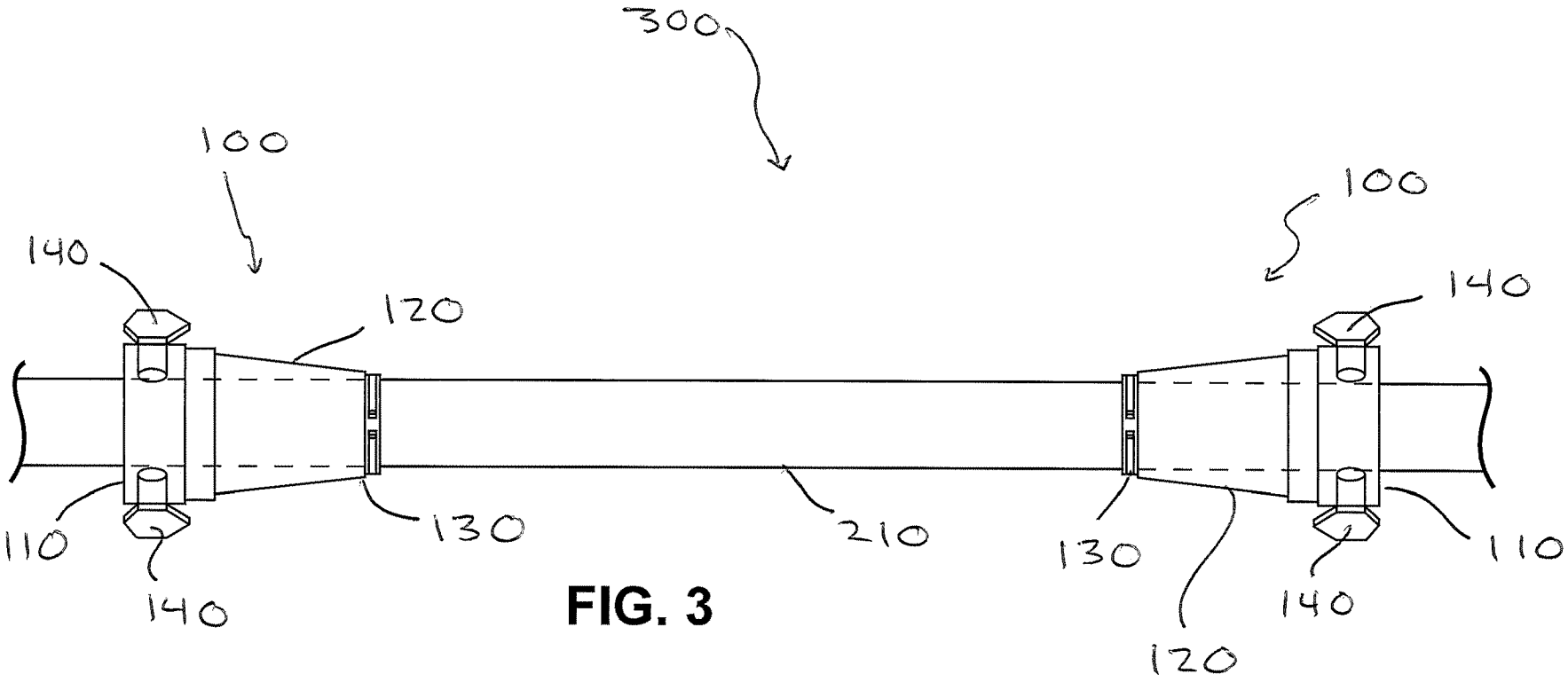
FIG. 3 is a side view of the assembled apparatus.

Referring now to FIG. 3, a side view is shown of an assembled apparatus for retaining a utility spool 300 comprising a first rotational collar 100 and a second rotational collar 100 wherein a gap in between said rotational collars 100 may be present. Both rotational collars 100 are fastened in a fixed location to a horizontal shaft 210 by means of set screws 140. In this view, both rotational collars 100 are related to that of which is shown in FIG. 1 where said rotational collar 100 is comprised of a first sleeve 110, a second frusto-conical sleeve 120, a retainer ring 130, and set screws 140.

Figure 4:
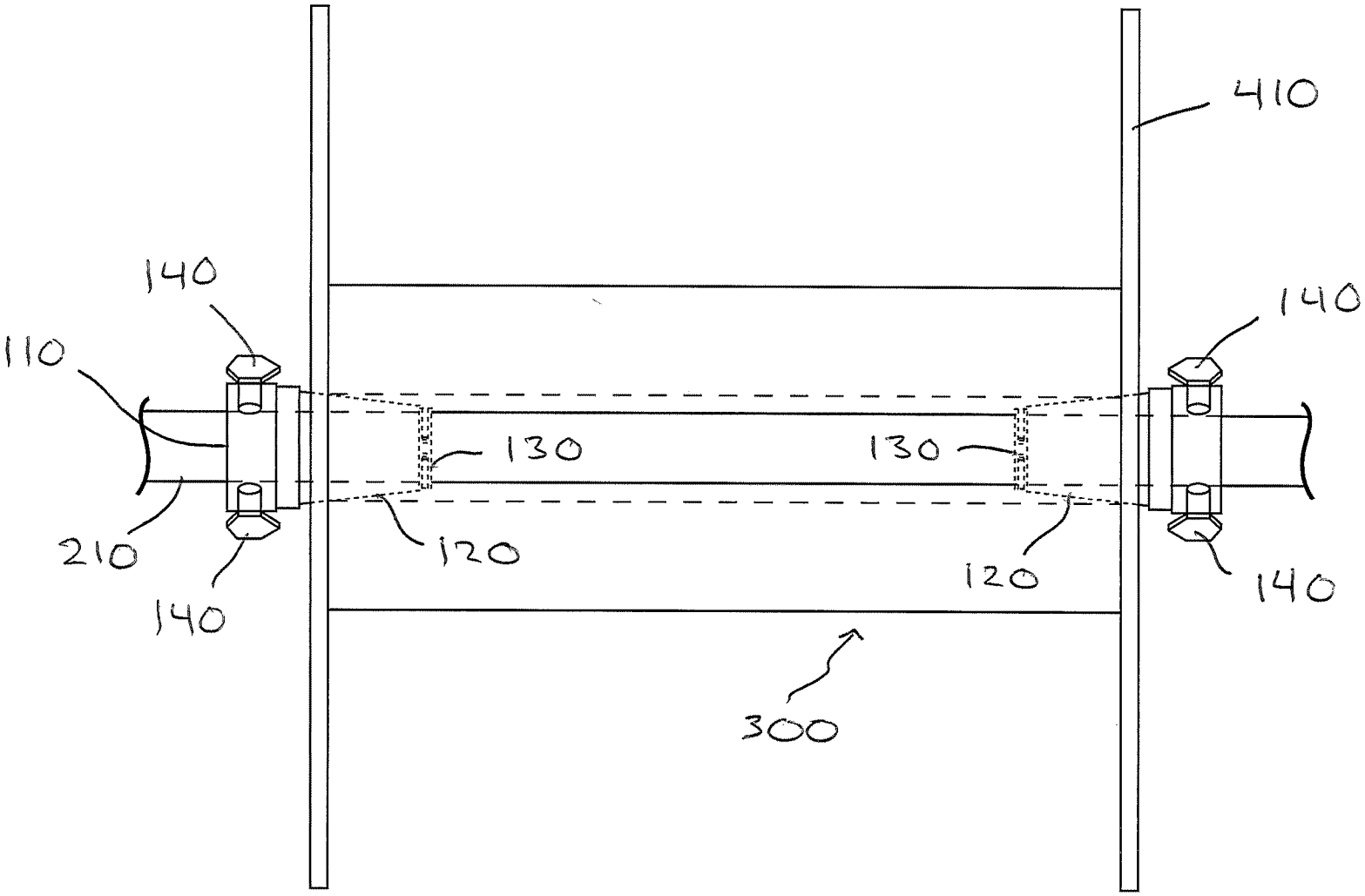
FIG. 4 is a side view of the assembled apparatus for retaining a utility spool.

Referring now to FIG. 4, a side view is shown of an assembled apparatus for retaining a utility spool 300 with an example of a utility spool 410 attached to both rotational collars 100. In this view, both rotational collars 100 are related to that of which is shown in FIG. 1 where said rotational collar 100 is comprised of a first sleeve 110, a second frusto-conical sleeve 120, a retainer ring 130, and set screws 140. In this embodiment, rotational collars 100 are positioned on a horizontal shaft 210 and inserted at least partially on each side of the utility spool 410 wherein the utility spool 410 makes contact with the second frusto-conical sleeve 120 on each rotational collar 100 allowing the utility spool 410 to rotate by means of the second frusto-conical sleeve 120 rotating on the first sleeve 110.

Figure 5:
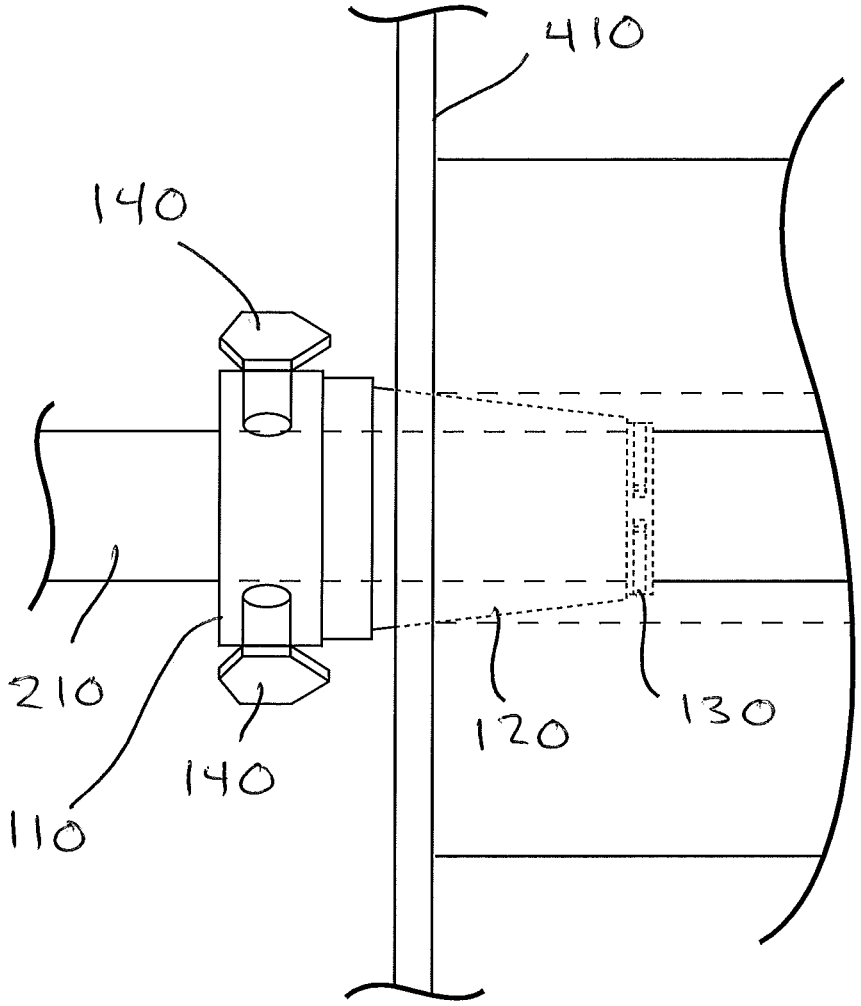
FIG. 5 is an enlarged view of a portion of FIG. 4.

Referring now to FIG. 5, an enlarged view of a portion of FIG. 4 is shown. In this view, a rotational collar 100 is related to that of which is shown in FIG. 1 where said rotational collar 100 is comprised of a first sleeve 110, a second frusto-conical sleeve 120, a retainer ring 130, and set screws 140. By way of example, the rotational collar 100 is capable of securing multiple different sizes of inner diameters on a utility spool 410.

Figure 6:
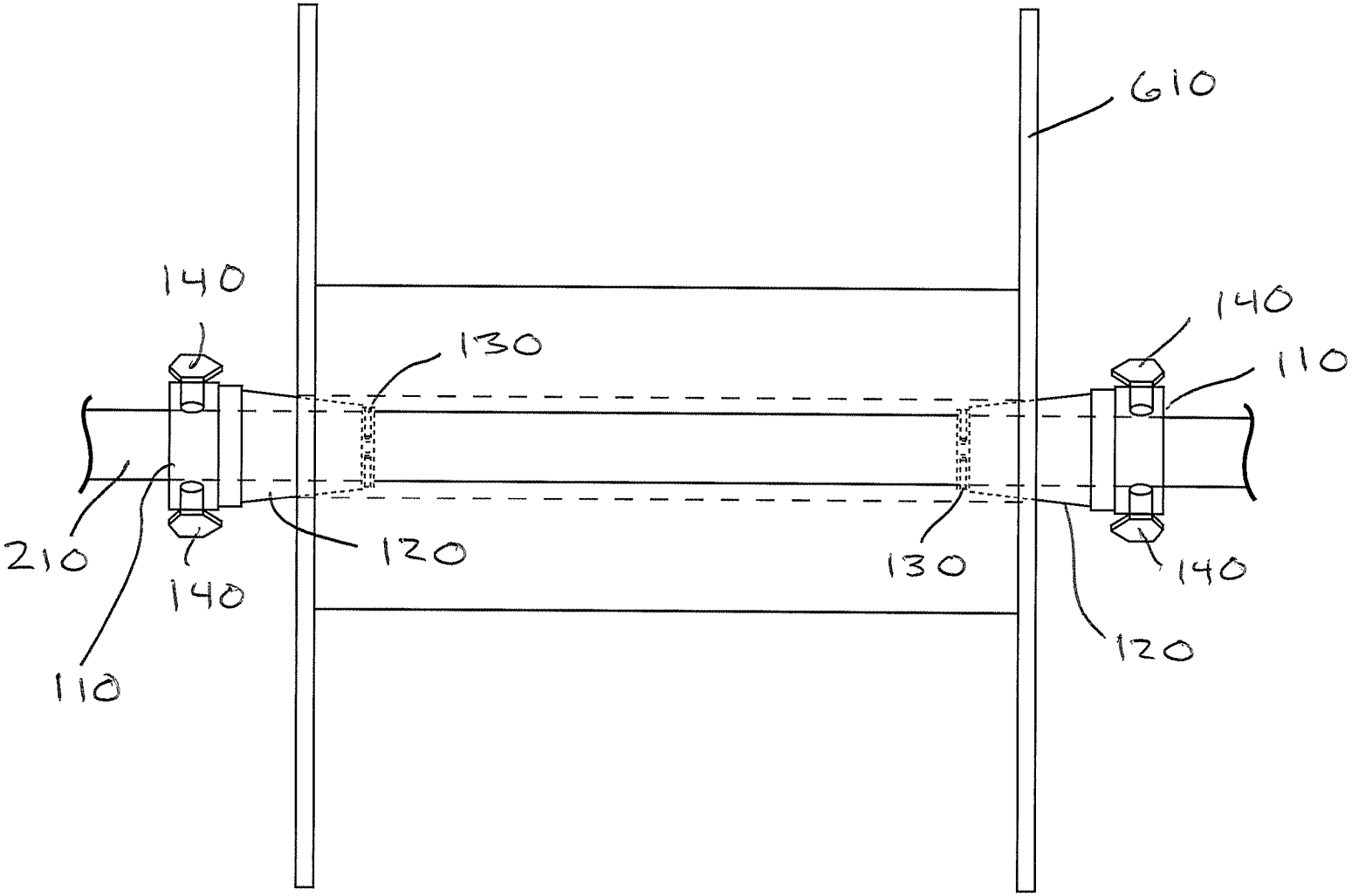
FIG. 6 depicts another side view of the assembled apparatus for retaining a utility spool of smaller inner diameter.

Referring now to FIG. 6, another side view of the assembled apparatus for retaining a utility spool of smaller inner diameter is shown. In this view, both rotational collars 100 are related to that of which is shown in FIG. 1 where said rotational collar 100 is comprised of a first sleeve 110, a second frusto-conical sleeve 120, a retainer ring 130, and set screws 140. In this embodiment, rotational collars 100 are positioned on a horizontal shaft 210 and inserted at least partially on each side of the utility spool 610 wherein the utility spool 410 makes contact with the second frusto-conical sleeve 120 on each rotational collar 100 allowing the utility spool 410 to rotate by means of the second frusto-conical sleeve 120 rotating on the first sleeve 110. By way of example, this embodiment shows the versatileness of the rotational collars 100 encompassing a variety of inner diameter sizes wherein the inner diameter of the utility spool 410 is smaller than that of which is shown in FIG. 4.

Figure 7:
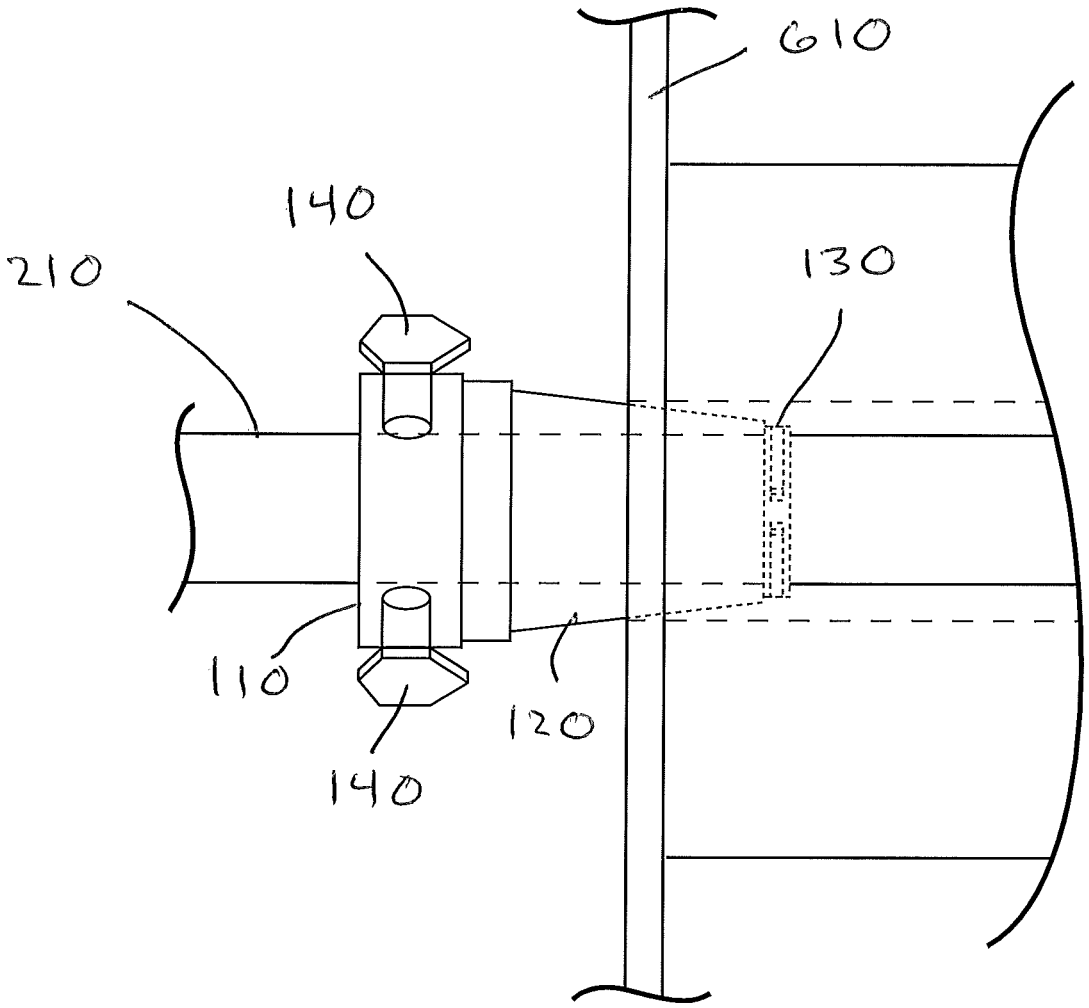
FIG. 7 is an enlarged view of a portion of FIG. 6.

Referring now to FIG. 7, an enlarged view of a portion of FIG. 6 is shown. In this view, a rotational collar 100 is related to that of which is shown in FIG. 1 where said rotational collar 100 is comprised of a first sleeve 110, a second frusto-conical sleeve 120, a retainer ring 130, and set screws 140. By way of example, the rotational collar 100 is capable of securing multiple different sizes of inner diameters on a utility spool 610.

Figure 8:
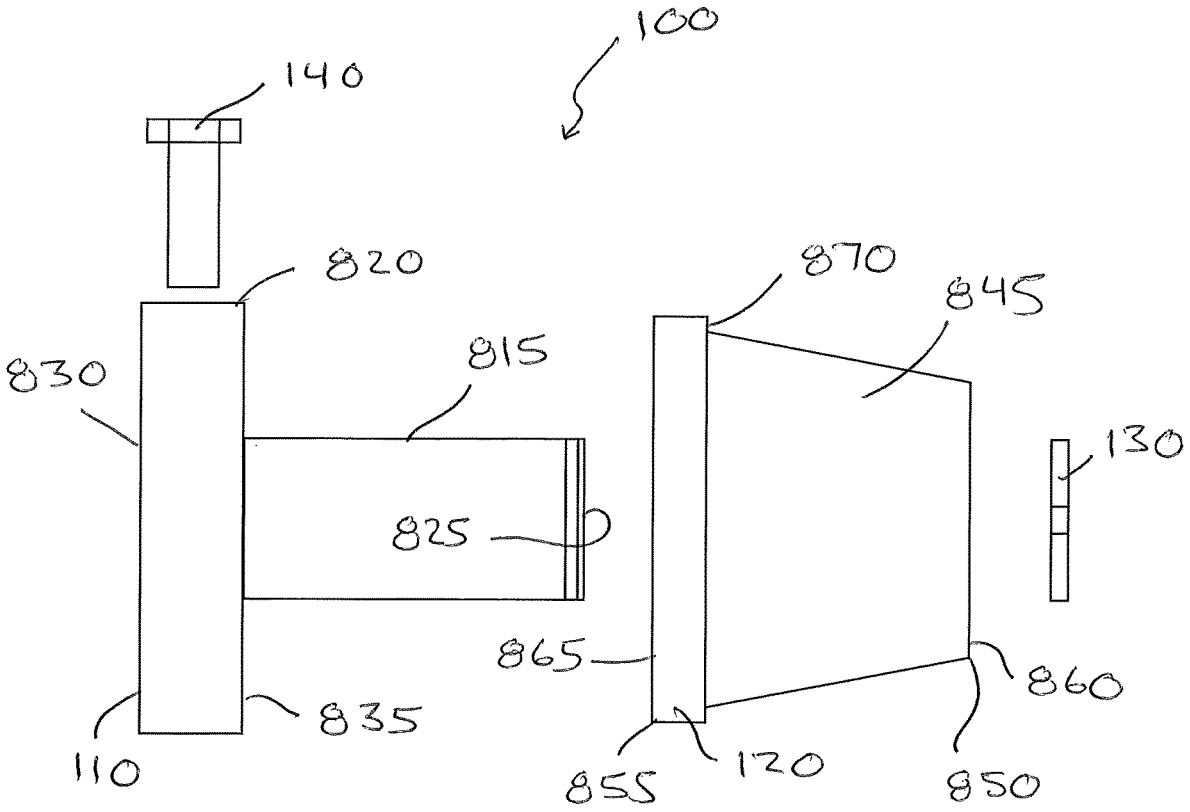
FIG. 8 is an exploded view of one rotational collar.

Referring now to FIG. 8, an exploded view of one rotational collar 100 is shown. The rotational collar 100 shown includes a first sleeve 110 comprising a first outer diameter 815, a second outer diameter 820, a first end 825, a second end 830, and an external flange 835. The rotational collar 100 shown additionally includes a second frusto-conical sleeve 120 comprising a frusto-conical outer surface 845, a first outer diameter 850, a second outer diameter 855, a first end 860, a second end 865, and a lip 870 separating the frusto-conical outer surface 845 from the second outer diameter 855. The second frusto-conical sleeve 120 is slipped over the first outer diameter 815 of the first sleeve 110 wherein the second end 865 of the second frusto-conical sleeve 120 abuts the external flange 835 of the first sleeve 110. The second frusto-conical sleeve 120 is secured in position by a means of a retainer ring 130, said first sleeve 110 and second frusto-conical sleeve 120 forming a lubricious surface allowing the second frusto-conical sleeve 120 to rotate freely while the first sleeve 110 does not rotate. Set screws 140 are used to fix the rotational collar 100 in place. The first end 825 of the first sleeve 110 is directly related to the positioning of the first end 860 of the second frusto-conical sleeve 120. The second end 830 of the first sleeve 110 is directly related to the positioning of the second end 865 of the second frusto-conical sleeve 120.

Figure 9:
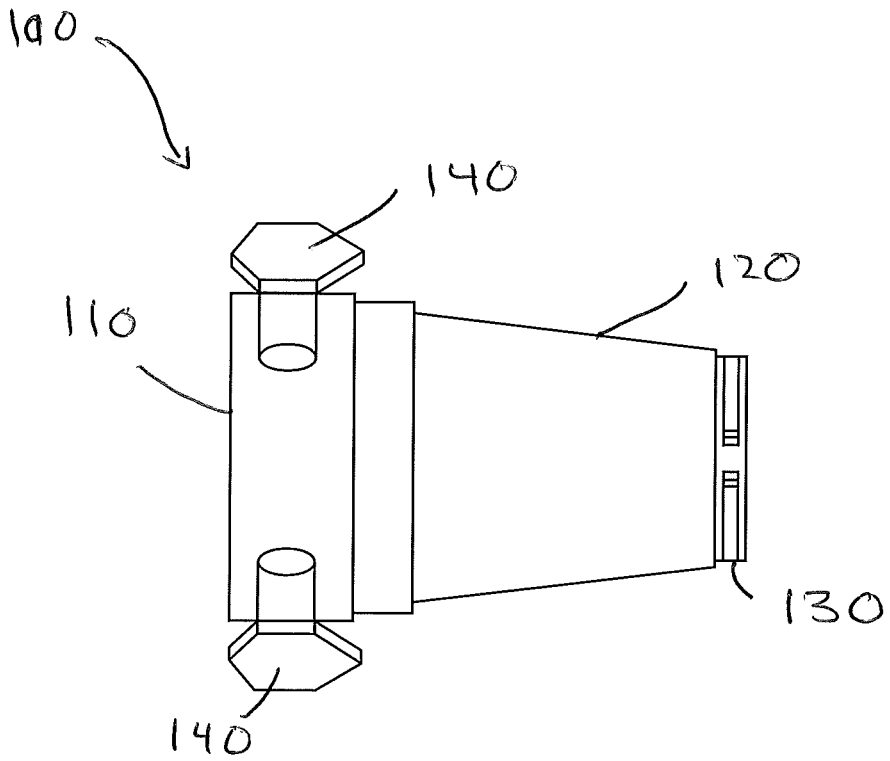
FIG. 9 is a side view of one side of a rotational collar.

Referring now to FIG. 9, a side view of one side of a rotational collar 100 is shown. In this view, the rotational collar 100 is related to that of which is shown in FIG. 1 where said rotational collar 100 is comprised of a first sleeve 110, a second frusto-conical sleeve 120, a retainer ring 130, and set screws 140.

Figure 10:
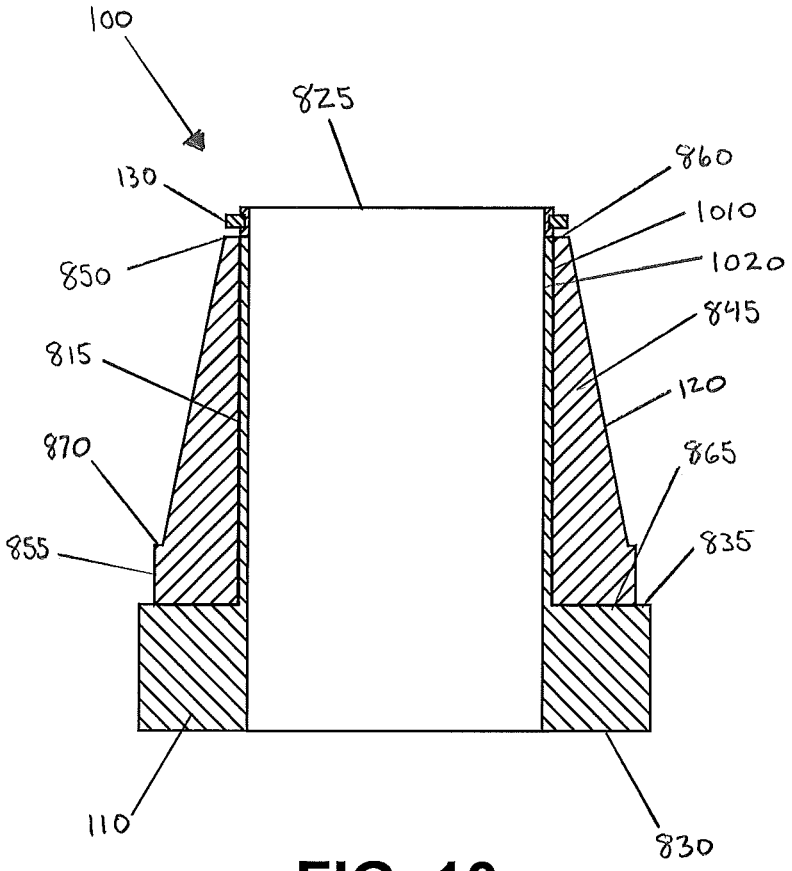
FIG. 10 is a cross sectional view of one rotational collar.

Referring now to FIG. 10, a cross sectional view of one rotational collar 100 is shown. In this view, the rotational collar 100 is related to that of which is shown in FIG. 8 where said rotational collar 100 is comprised of a first sleeve 110 which contains a first outer diameter 815, a second outer diameter 820, a first end 835, a second end 830, and an external flange. Said rotational collar 100 is comprised of a second frusto-conical sleeve 120 which contains a frusto-conical outer surface 845, a first outer diameter 850, a second diameter 855, a first end 860, a second end 865, and a lip 870. The rotational collar 100 is also comprised of a retainer ring 130 and set screws 140. Additionally, the first sleeve 110 contains an inner diameter 1020 for purposes of slipping over the exterior surface of a horizontal shaft 210. In some embodiments said inner diameter 1020 makes contact with the horizontal shaft 210. The second frusto-conical sleeve 120 comprises an inner surface 1010 to make contact with the first outer diameter 815 on the first sleeve 110. Said contact between the inner surface 1010 and first outer diameter 815 forms a lubricious surface capable of rotation.

Figure 11:
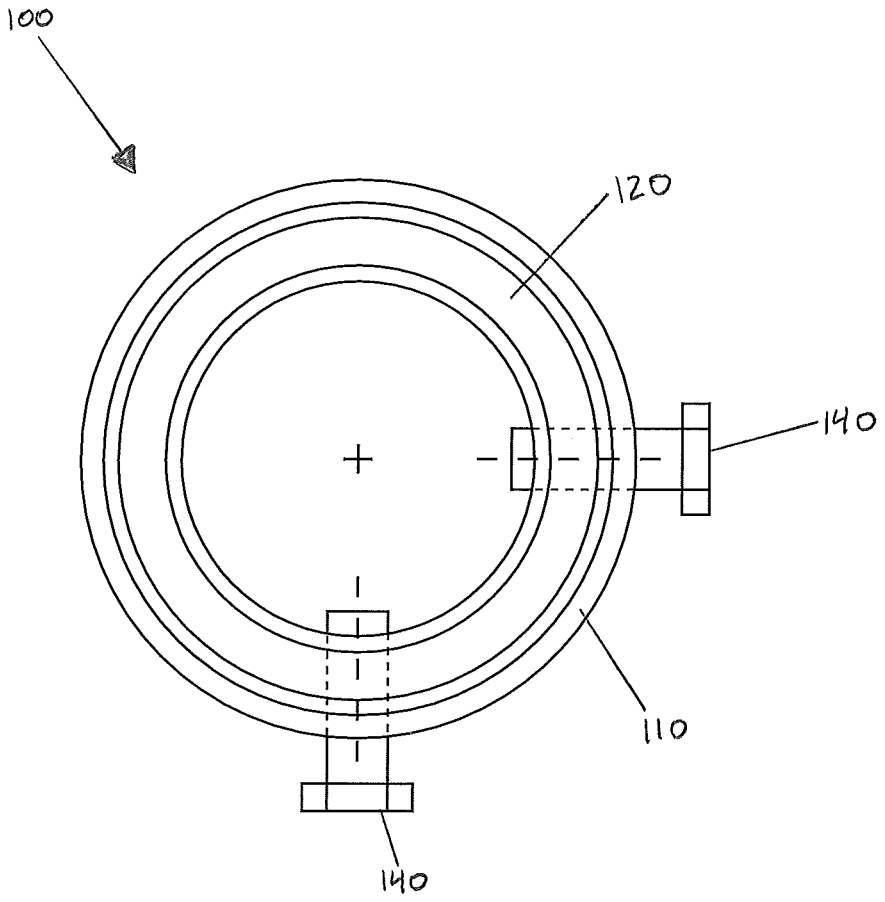
FIG. 11 is a top planar view of one example of one rotational collar.

In some embodiments said rotational collar 100 is comprised of two or more set screws 140. Referring now to FIG. 11, a top planar view of one example of a rotational collar is shown in accordance with various embodiments herein. In this view, the rotational collar 100 is related to that of which is shown in FIG. 1 where said rotational collar 100 is comprised of a first sleeve 110, a second frusto-conical sleeve 120, a retainer ring 130, and set screws 140.

Figure 12:
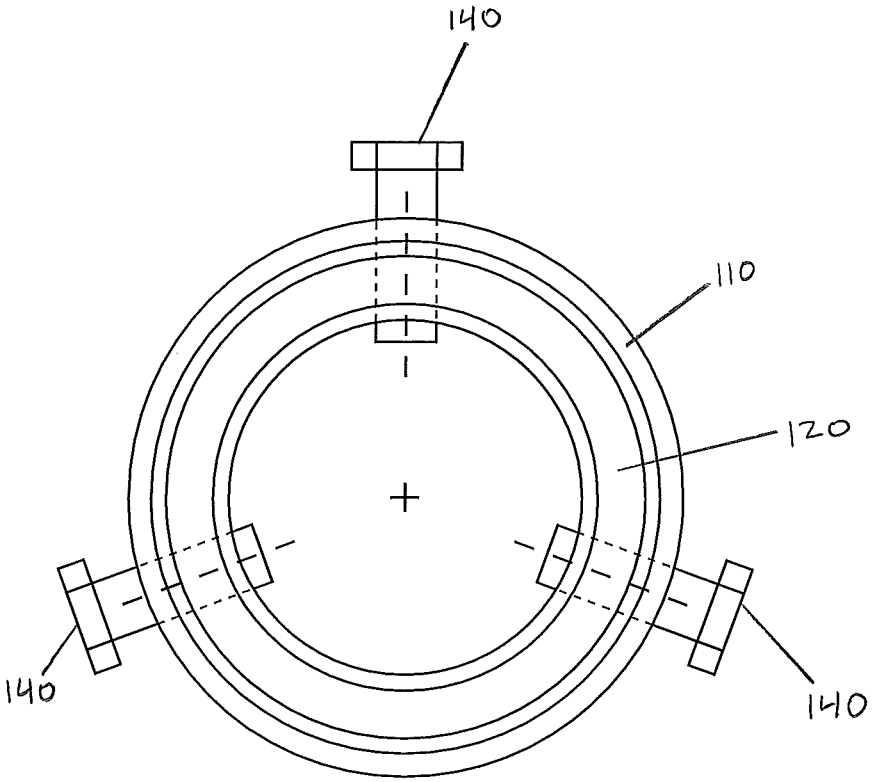
FIG. 12 is a top planar view depicting another example of one rotational collar.

In some embodiments said rotational collar 100 is comprised of three or more set screws 140 offset by 120 degrees. Referring now to FIG. 12, a top planar view of one example of a rotational collar is shown. In this view, the rotational collar 100 is related to that of which is shown in FIG. 1 where said rotational collar 100 is comprised of a first sleeve 110, a second frusto-conical sleeve 120, a retainer ring 130, and set screws 140.

Figure 13:
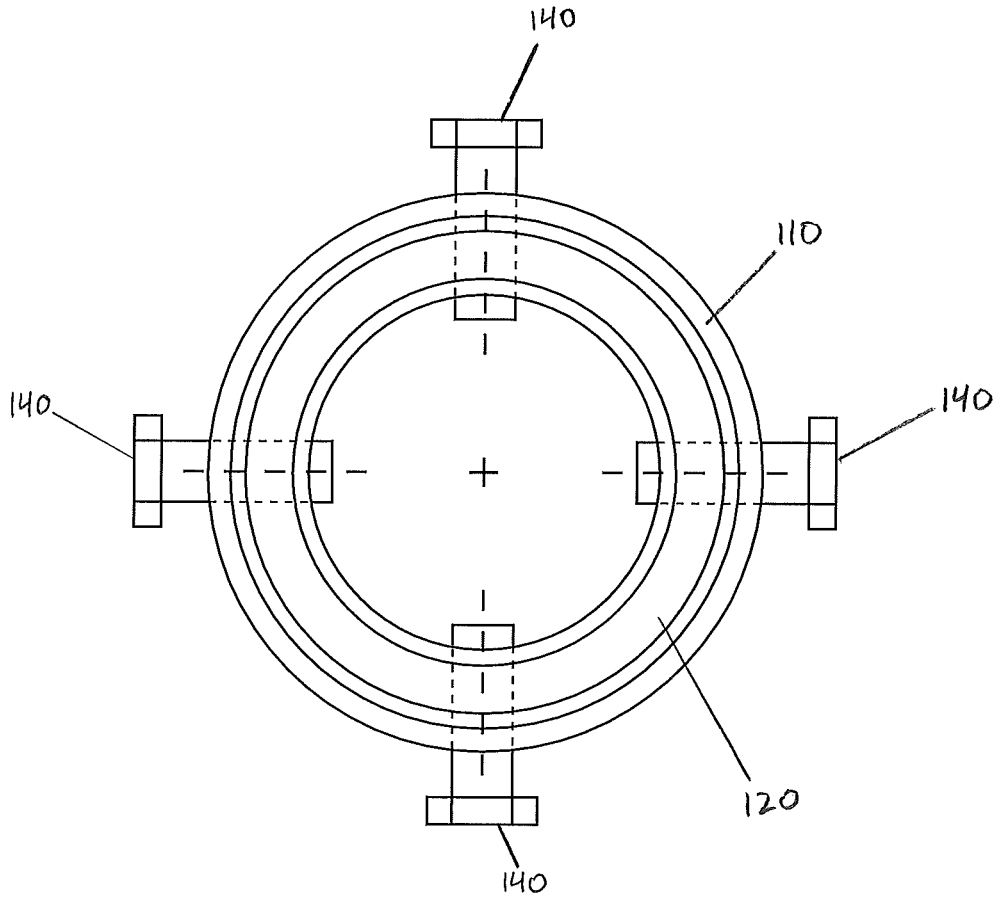
FIG. 13 is a top planar view depicting another example of one rotational collar.

In other embodiments, said rotational collar 100 is comprised of four or more set screws 140 offset by 90 degrees. Referring now to FIG. 13, a top planar view of one example of a rotational collar is shown. In this view, the rotational collar 100 is related to that of which is shown in FIG. 1 where said rotational collar 100 is comprised of a first sleeve 110, a second frusto-conical sleeve 120, a retainer ring 130, and set screws 140.

Figure 14:
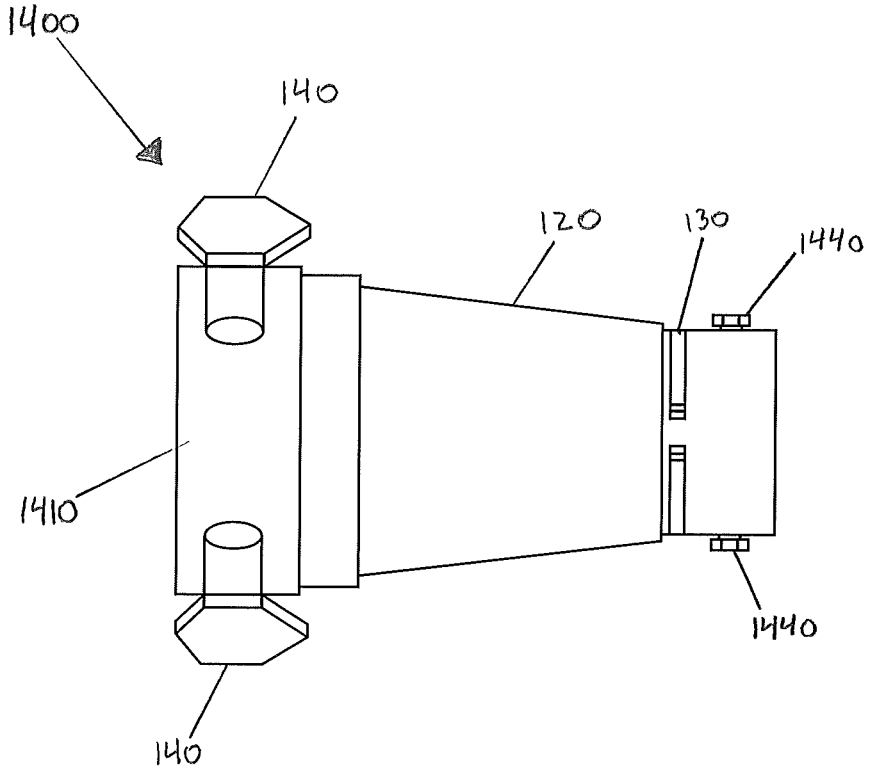
FIG. 14 is a side view of an alternative of a rotational collar.

Referring now to FIG. 14, a side view of an alternative of a rotational collar 1400 is shown. In this embodiment, the rotational collar 1400 is related to that of which is shown in FIG. 1 wherein said rotational collar 1400 is comprised of an alternate first sleeve 1410, a second frusto-conical sleeve 120, a retainer ring 130, and set screws 140. In this embodiment, the alternate first sleeve 1410 extends further past the second frusto-conical sleeve 120 to allow the rotational collar 1400 to encompass multiple horizontal shaft diameters by means of using additional set screws to fasten said rotational collar 1400 to alternative horizontal shafts.

Figure 15:
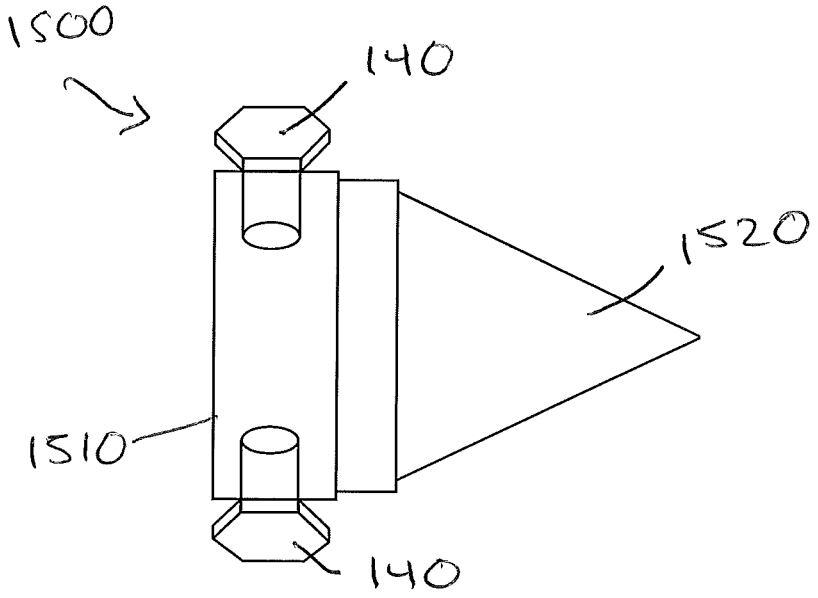
FIG. 15 is a side view of another alternative of a rotational collar.

Referring now to FIG. 15, a side view of another alternative of a rotational collar 1500 is shown. In this embodiment, the rotational collar 1500 is comprised of an alternate first sleeve 1510, a second conical sleeve 1520, and set screws 140 for securing the rotational collars 1500 onto a horizontal shaft. This embodiment would be useful for non-continuous horizontal shafts wherein said rotational collars 1500 would be positioned at each end of a shaft for means of retaining a utility spool 410.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications are herein incorporated by reference to the same extent as if each individual publication or patent application was specifically and individually indicated by reference.

Aspects have been described with reference to various specific and preferred embodiments and techniques. However, it should be understood that many variations and modifications may be made while remaining within the spirit and scope herein.

The invention claimed is:

1. An apparatus for retaining a utility spool on a horizontal shaft, said apparatus comprising: a first rotational collar and a second rotational collar configured to be attached to the horizontal shaft on either side of the utility spool to allow rotation of the utility spool independent of the shaft, wherein each of the two rotational collars contain:

a) a first sleeve comprising an inner surface and an outer surface of cylindrical geometry, the first sleeve having:
   1) an inner diameter,
   2) a first outer diameter, and
   3) a second outer diameter, the first outer diameter located on a first end of the sleeve and the second outer diameter located on a second end of the sleeve, the second end indicated by an external flange extending out of the profile and at least one hole through the flange for securing a fastener through the flange and to the horizontal shaft:

b) a second frusto-conical sleeve; overlaying and partially surrounding the first sleeve;

1) a first outer diameter on a first end of the second sleeve, 2) a second outer diameter on a second end of the second sleeve;

wherein the first sleeve and second frusto-conical sleeve make contact with one another and form a cylindrical lubricious surface;

wherein the second end of the second sleeve abuts to the external flange on the first sleeve and the external flange prevents horizontal movement of the second sleeve relative to the first sleeve, the outer surface of the first sleeve forming a cylindrical lubricious surface with the inner surface of the second sleeve, the lubricious surface extending along the majority of the inner surface of the second sleeve, such that the second sleeve freely rotates relative to the first sleeve around the lubricious surface, and containing a lip separating the frusto-conical outer surface from the second outer diameter;

wherein when installed the first rotational collar and the second rotational collar face opposite each other when positioned inside each side of the utility spool such that the second frusto-conical sleeves rotate freely relative to the first sleeves.

2. The invention of claim 1, wherein said apparatus further comprises of set screws to fasten apparatus to a shaft, the set screws not removable.

3. The invention of claim 2, wherein said apparatus further comprises of at least 3 set screws to fasten apparatus to the shaft.

4. The invention of claim 2, wherein said apparatus further comprises of at least 4 set screws to fasten apparatus to shaft.

5. The invention of claim 1, wherein a retainer ring is used to fix the second sleeve to the first sleeve.

6. The invention of claim 1, wherein the first sleeve is comprised of steel and the second sleeve is comprised of brass.

7. The invention of claim 1, wherein the first sleeve is comprised of a plastic material and the second sleeve is comprised of a plastic material.

8. The invention of claim 1, wherein the second sleeve can encompass spool diameters between 3-3.5 inches.

9. The invention of claim 1, wherein the apparatus can be adaptable to varying shaft diameter by means of set screws.

10. The invention of claim 1, wherein the lubricious surface is comprised of a bearing assembly.

11. An apparatus for retaining a utility spool on a horizontal shaft, said apparatus comprising:

a first rotational collar and a second rotational collar configured to be attached to the horizontal shaft on either side of the utility spool to allow rotation of the utility spool independent of the shaft, wherein each of the two rotational collars contain:

a) a first sleeve comprising an inner surface and an outer surface of cylindrical geometry, the first sleeve having:

1) an inner diameter, 2) a first outer diameter, and 3) a second outer diameter, the first outer diameter located on a first end of the sleeve and the second outer diameter located on a second end of the sleeve, the second end indicated by an external flange extending out of the profile and at least one hole through the flange for securing a fastener through the flange and to the horizontal shaft; and b) a second sleeve comprising an inner surface and a frusto-conical outer surface, the second sleeve having:

1) a first outer diameter on a first end of the second sleeve, 2) a second outer diameter on a second end of the second sleeve the second outer diameter being no more than 1.5 times greater than the inner diameter of the first sleeve, the thickness of the first end being less than 4 times the thickness of the second end, the angle formed by the frusto-conical outer surface and inner surface is between 15-25 degrees, and containing a lip separating the frusto-conical outer surface from the second outer diameter;

wherein the second end of the second sleeve abuts to the external flange on the first sleeve, and the external flange prevents horizontal movement of the second sleeve relative to the first sleeve the outer surface of the first sleeve forming a cylindrical lubricious surface with the inner surface of the second sleeve, the lubricious surface extending along the majority of the inner surface of the second sleeve, such that the second sleeve freely rotates relative to the first sleeve, and wherein the inner surface of the first sleeve does not rotate relative to the horizontal shaft but the second sleeve does rotate relative to the horizontal shaft;

wherein when installed the first ends face one another while at least partially inserted into a spool opening and the second ends oppose one another.

12. The invention of claim 11, wherein said apparatus further comprises of at least 3 set screws to fasten apparatus to shaft; other than by cutting, grinding, or similar step.

13. The invention of claim 11, wherein said apparatus further comprises of at least 4 set screws to fasten apparatus to shaft.

14. The invention of claim 11, wherein a retainer ring is used to fix the second sleeve to the first sleeve.

15. The invention of claim 11, wherein the first sleeve is comprised of steel and the second sleeve is comprised of brass.

16. The invention of claim 11, wherein the first sleeve is comprised of a plastic material and the second sleeve is comprised of a plastic material.

17. The invention of claim 11, wherein the second sleeve can encompass spool diameters between 3-3.5 inches.

18. The invention of claim 11, wherein the apparatus can be adaptable to varying shaft diameter by means of set screws.

19. The invention of claim 11, wherein the lubricious surface is comprised of a bearing assembly.

* * * * *